US009124039B2

(12) United States Patent
Masuda et al.

(10) Patent No.: US 9,124,039 B2
(45) Date of Patent: Sep. 1, 2015

(54) CONNECTOR

(71) Applicant: FUJITSU LIMITED, Kawasaki-shi, Kanagawa (JP)

(72) Inventors: Yasushi Masuda, Kawasaki (JP); Akira Tamura, Yokohama (JP); Satoshi Ohsawa, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/283,851

(22) Filed: May 21, 2014

(65) Prior Publication Data

US 2014/0349495 A1 Nov. 27, 2014

(30) Foreign Application Priority Data

May 27, 2013 (JP) ..... 2013-111263

(51) Int. Cl.
*H01R 13/6586* (2011.01)
*H01R 13/6587* (2011.01)
*H01R 12/57* (2011.01)
*H01R 12/58* (2011.01)

(52) U.S. Cl.
CPC ..... *H01R 13/6587* (2013.01); *H01R 12/57* (2013.01); *H01R 12/585* (2013.01)

(58) Field of Classification Search
CPC ..... H01R 13/6586; H01R 13/6587; H01R 23/688
See application file for complete search history.

(56) References Cited

U.S. PATENT DOCUMENTS 6,394,822 B1 * 5/2002 McNamara ..... 439/108
6,471,549 B1 * 10/2002 Lappohn ..... 439/607.05
6,530,790 B1 * 3/2003 McNamara et al. ..... 439/108
6,537,087 B2 * 3/2003 McNamara et al. ..... 439/108
6,663,429 B1 * 12/2003 Korsunsky et al. ..... 439/607.07
6,702,590 B2 * 3/2004 Zaderej et al. ..... 439/74
6,776,659 B1 * 8/2004 Stokoe et al. ..... 439/607.11
6,780,059 B1 * 8/2004 Payne et al. ..... 439/607.39
6,814,619 B1 * 11/2004 Stokoe et al. ..... 439/607.07
6,827,611 B1 * 12/2004 Payne et al. ..... 439/607.05
6,843,687 B2 * 1/2005 McGowan et al. ..... 439/607.06
7,267,515 B2 * 9/2007 Lappohn ..... 439/607.07
7,651,337 B2 * 1/2010 McNamara ..... 439/65
7,837,475 B2 * 11/2010 Mizukami et al. ..... 439/65
7,950,963 B2 * 5/2011 Mizukami et al. ..... 439/607.07
8,157,592 B2 * 4/2012 Mizukami et al. ..... 439/607.07
8,272,877 B2 * 9/2012 Stokoe et al. ..... 439/55
8,491,313 B2 * 7/2013 McNamara et al. ..... 439/59
8,506,330 B2 * 8/2013 Mizukami et al. ..... 439/607.07
8,616,919 B2 * 12/2013 Stoner ..... 439/607.07

(Continued)

FOREIGN PATENT DOCUMENTS

JP 2-52289 U 4/1990
JP 2000-277219 A 10/2000

(Continued)

*Primary Examiner* — Ross Gushi

(74) *Attorney, Agent, or Firm* — Squire Patton Boggs (US) LLP

(57) ABSTRACT

A connector includes: a casing; a pair of signal terminals that have respective tip end portions, the pair of signal terminals projecting from the casing, the tip end portions being perpendicularly bent; a ground terminal arranged such that the ground terminal and the pair of signal terminals are arranged in a row, the ground terminal projecting at a position adjacent to the pair of signal terminals; and a shield disposed between the casing and the tip end portions of the pair of signal terminals.

8 Claims, 17 Drawing Sheets

(56) References Cited

U.S. PATENT DOCUMENTS

| | | | | |
|---|---|---|---|---|
| 8,657,627 | B2 * | 2/2014 | McNamara et al. | 439/607.11 |
| 8,734,187 | B2 * | 5/2014 | De Geest et al. | 439/626 |
| 8,753,148 | B2 * | 6/2014 | Wozniak | 439/607.05 |
| 8,920,195 | B2 * | 12/2014 | Cohen et al. | 439/607.1 |
| 2007/0155241 | A1 * | 7/2007 | Lappohn | 439/608 |
| 2008/0108233 | A1 * | 5/2008 | Jeon | 439/83 |
| 2011/0189892 | A1 * | 8/2011 | Mizukami et al. | 439/607.34 |
| 2012/0135641 | A1 * | 5/2012 | Okuyama et al. | 439/626 |
| 2012/0193139 | A1 * | 8/2012 | Okuyama et al. | 174/551 |
| 2014/0349495 | A1 * | 11/2014 | Masuda et al. | 439/108 |
| 2015/0072558 | A1 * | 3/2015 | Buck et al. | 439/607.05 |

FOREIGN PATENT DOCUMENTS

| | | | |
|---|---|---|---|
| JP | 2000-311736 | A | 11/2000 |
| JP | 2004-103527 | A | 4/2004 |

* cited by examiner

CONNECTOR

CROSS-REFERENCE TO RELATED APPLICATION

This application is based upon and claims the benefit of priority from the prior Japanese Patent Application No. 2013-111263 filed on May 27, 2013, the entire contents of which are incorporated herein by reference.

FIELD

The embodiments discussed herein are related to a connector.

BACKGROUND

A related-art connector that includes a transmission line assembly and a housing, in which the transmission line assembly is housed, is used. The transmission line assembly of this connector includes a plurality of insert-molded signal contact components and a metal ground contact. The insert-molded signal contact components include signal contacts and insulating members that hold the signal contacts. The metal ground contact is disposed between the adjacent insert-molded signal contact components. The transmission line assembly of the connector also includes a pair of metal ground plates secured to the ground contact such that electrical conduction is established between the ground plates and the ground contact and the ground contact disposed between the insert-molded signal contact components is clamped by the ground plates.

The following is a reference document.

[Document 1] Japanese Laid-open Patent Publication No. 2004-103527.

SUMMARY

According to an aspect of the invention, a connector includes: a casing; a pair of signal terminals that have respective tip end portions, the pair of signal terminals projecting from the casing, the tip end portions being perpendicularly bent; a ground terminal arranged such that the ground terminal and the pair of signal terminals are arranged in a row, the ground terminal projecting at a position adjacent to the pair of signal terminals; and a shield disposed between the casing and the tip end portions of the pair of signal terminals.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Before describing embodiments, to which a connector according to the present application is applied, a connector according to an underlying technology of the embodiments is described.

Figure 1A:
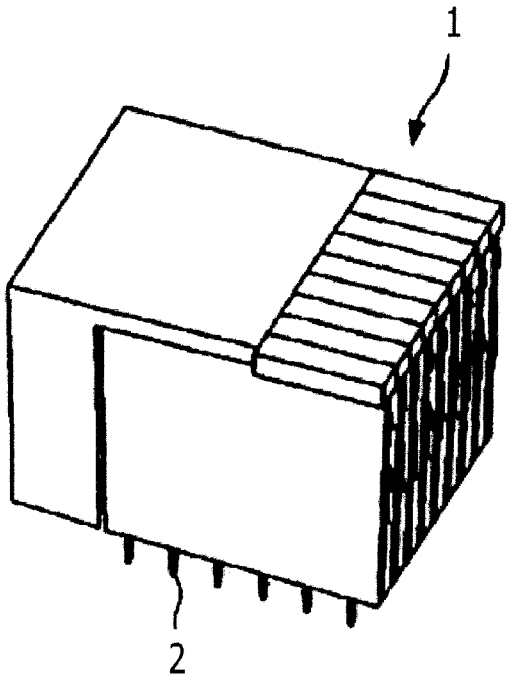
FIGS. 1A and 1B illustrate a press-fit connector according to an underlying technology.
Figure 1B:
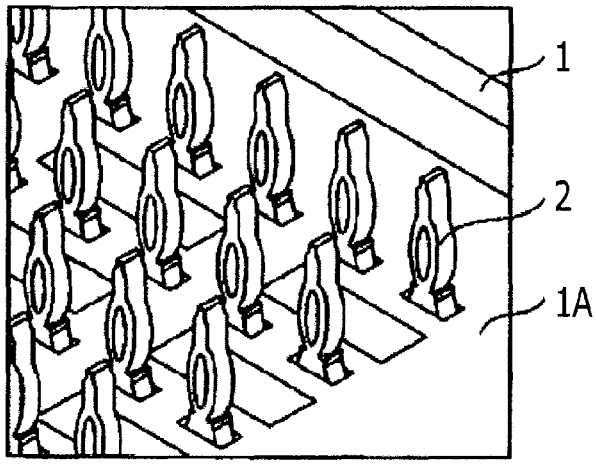

FIGS. 1A and 1B illustrate a press-fit connector 1 according to an underlying technology. The press-fit connector 1 of the underlying technology illustrated in FIG. 1A are to be mounted on a surface of a board. The board conforms to standards such as, for example, Flame Retardant type 4 (FR-4) and is used for a backplane.

As illustrated in FIG. 1B, a number of press-fit pins 2 are arranged in a matrix on an opposing surface 1A of the press-fit connector 1, the opposing surface 1A opposing the board.

Figure 2:
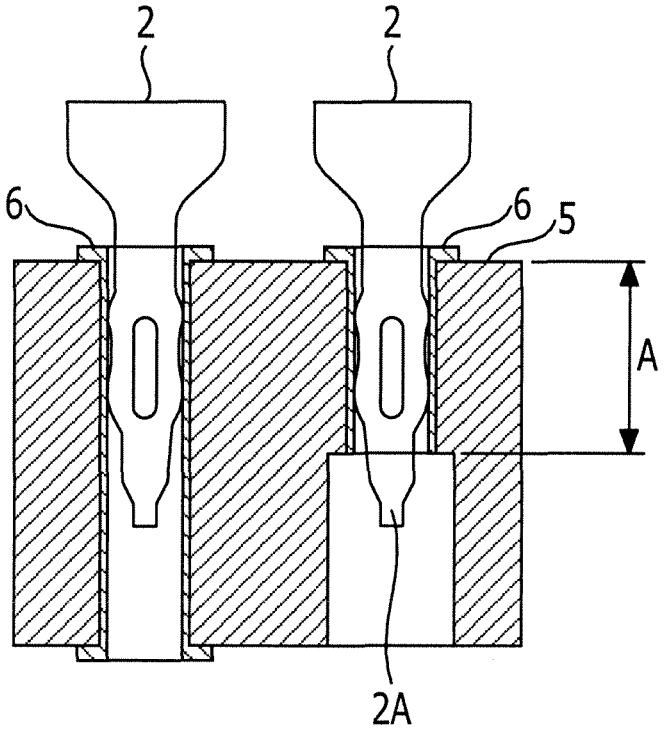
FIG. 2 is a sectional view illustrating a state in which press-fit pins according to the underlying technology are press fitted into through holes of a board.

FIG. 2 is a sectional view illustrating a state in which the press-fit pins 2 according to the underlying technology are press fitted into through holes 6 of a board 5.

The through holes 6 are formed in the board 5. The through holes 6 are formed by, for example, making through holes in the board 5 and forming a copper plating film on an inner wall of each of the through holes. The inner diameter of the through holes 6 are set to be slightly smaller than the width of the press-fit pins 2. Thus, the press-fit pins 2, which is press fitted from above in FIG. 2, may be fitted into the through holes 6. The press-fit pins 2 are connected to the through holes 6 without using solder.

The press-fit pin 2 having been press fitted into the through hole 6 is in a state illustrated on the left in FIG. 2. In this state, a substantially half of the through hole 6 on the lower side is not connected to the press-fit pin 2.

The lower halves of the through holes 6 not connected to the respective press-fit pins 2 as described above serve as stubs for signals transmitted to the press-fit pins 2 and may become the sources of noise. Thus, as illustrated on the right in FIG. 2, the stubs are removed by so-called back drilling.

Since the press-fit pins 2 are easily mounted, press-fit type connectors are used in many cases in particular for backplanes through which signals are transmitted at high-speed.

Connectors such as so-called Dual-In-Line Plug (DIP) connectors are inserted into the through holes 6 and, in this inserted state, subjected to soldering. Compared to such connectors, press-fit type connectors such as the press-fit connector 1 realize desirable manufacturing quality.

The press-fit type connectors such as the press-fit connector 1, the price of which are lower than that of surface mount technology (SMT) type connectors, have become widely used for the backplanes.

However, the press-fit pins 2 are not soldered. Thus, in order to reliably maintain the strength of the board 5 and the through holes 6, connecting portions where the press-fit pins 2 and the respective through holes 6 are connected to one another usually have a certain length (length in the axial direction of the through hole 6).

Furthermore, when connecting the press-fit pins 2 and the through holes 6 to one another, an allowance is usually provided by considering a shift in position or the like in the thickness direction of the board 5 (axial direction of the through holes 6).

For this reason, the length of the connecting portions where the through holes 6 and the respective press-fit pins 2 are in contact with one another, the length being indicated by arrow A on the right side of the press-fit pin 2 illustrated on the right side in FIG. 2, is usually set to at least about 1 mm.

As described above, the connection portions where the press-fit pins 2 and the through holes 6 are connected to one another usually have a certain length. Furthermore, in each through hole 6, there are portions where the through hole 6 is not connected to the press-fit pin 2 on the upper and lower side of the through hole 6 when the press-fit pin 2 and the through hole 6 are connected to one another.

Accordingly, when the speed of a signal transmitted through the press-fit connector 1 is increased to a certain high-speed, the upper and lower portions of the through holes 6, the portions being not connected to the press-fit pins 2, serve as stubs, which become the source of noise. That is, the upper and lower portions of the through holes 6, the portions being not connected to the press-fit pins 2, become the source of noise due to electrical slack.

Furthermore, a tip end 2A of the press-fit pin 2 on the right side in FIG. 2 projects further downward than a lower end of the through hole 6, the length of which has been reduced by back drilling. Thus, when the transmission speed of the signal is increased to a certain high speed, the tip end 2A of the press-fit pin 2 also becomes the stub and the source of noise.

Presently, the limit of the transmission speed of a signal that may be transmitted through the press-fit connector 1 is about 25 Gbps.

For this reason, the press-fit connector 1 is not suitable for signal transmission in an ultra-high speed range, the signal transmission speed of which exceeds, for example, 25 Gbps.

However, crowd computing, smartphones, and the like have become increasingly popular, and accordingly, the amount of information handled by servers or network equipment are increasing. Thus, there is a large demand for increasing the signal transmission speed.

Nowadays, discussion of ultra-high speed transmission (for example, equal to or higher than 40 Gbps) has been started.

Accordingly, the following embodiments are aimed at providing a connector having desirable electrical characteristics usable for ultra-high speed transmission.

The embodiments, to which the connector according to the present application is applied, are described below.

First Embodiment

Figure 3:
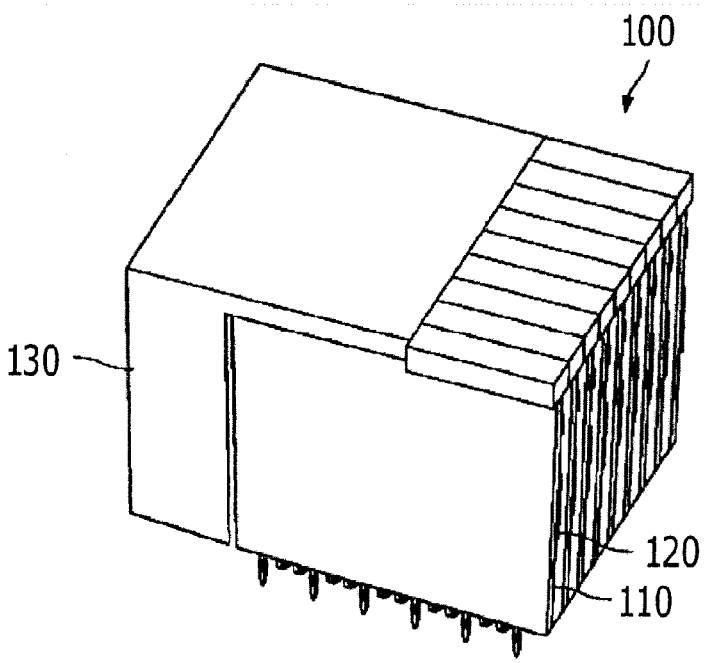
FIG. 3 illustrates a connector according to a first embodiment.
Figure 4:
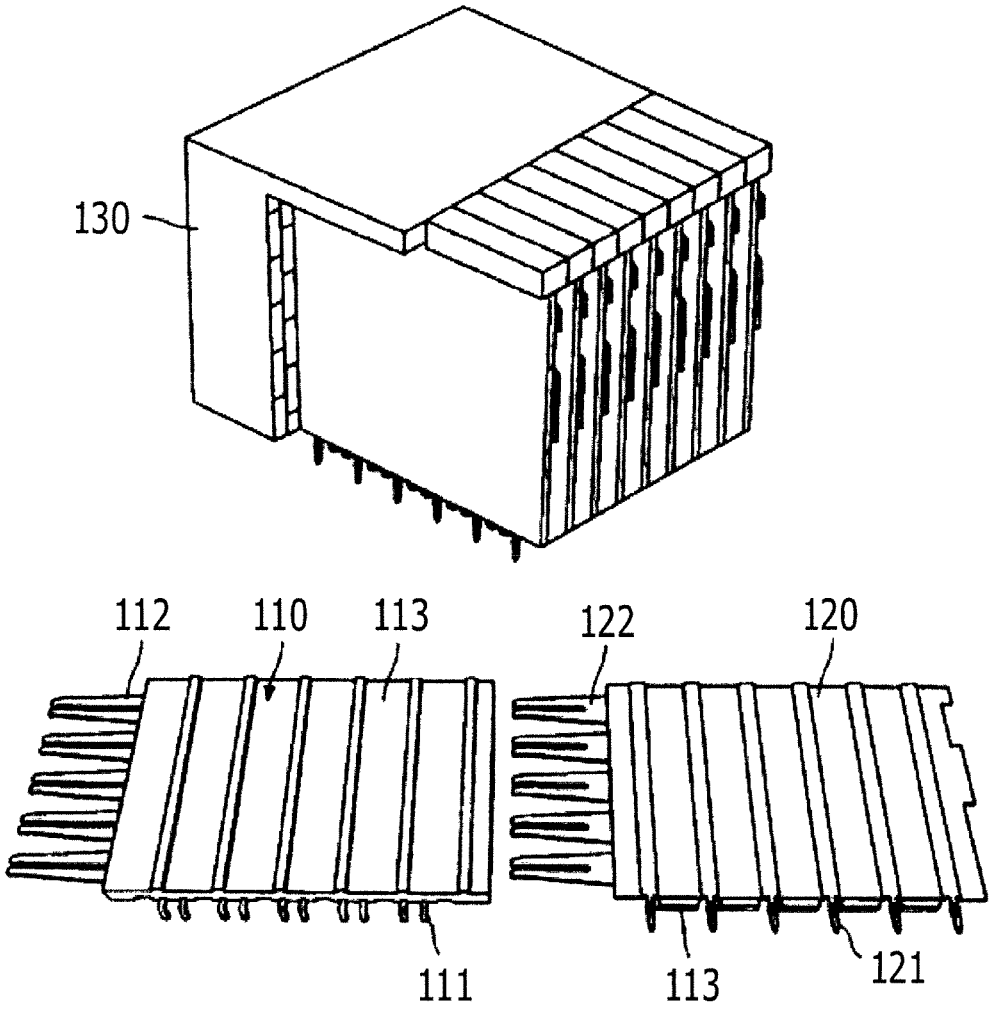
FIG. 4 illustrates the connector according to the first embodiment with some parts of the connector detached.

FIG. 3 illustrates a connector 100 according to a first embodiment. FIG. 4 illustrates the connector 100 according to the first embodiment with some parts of the connector detached. FIGS. 5A, 5B, 6A, and 6B illustrate elements of the connector 100 according to the first embodiment.

Figure 5A:
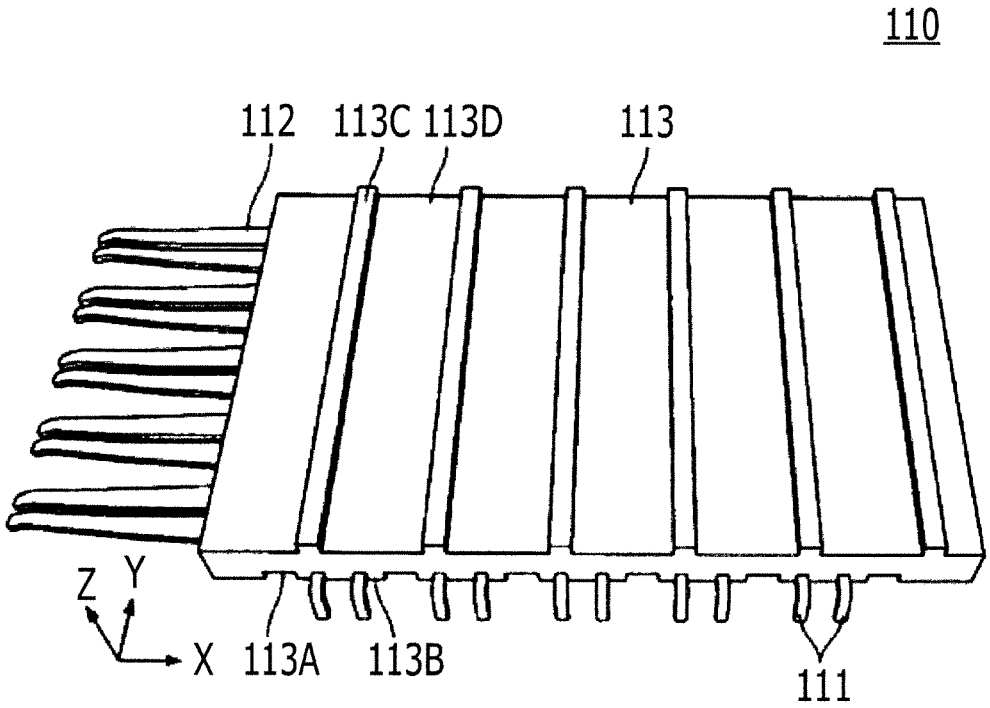
FIGS. 5A and 5B illustrate elements of the connector according to the first embodiment.
Figure 5B:
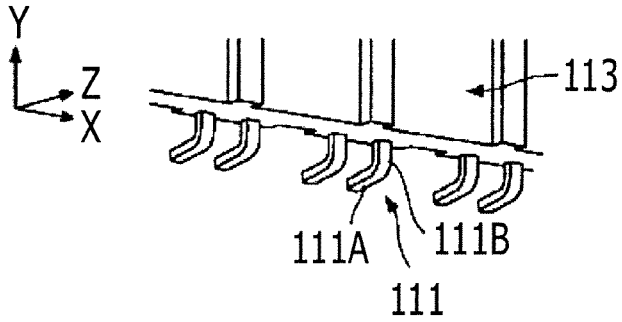
Figure 6A:
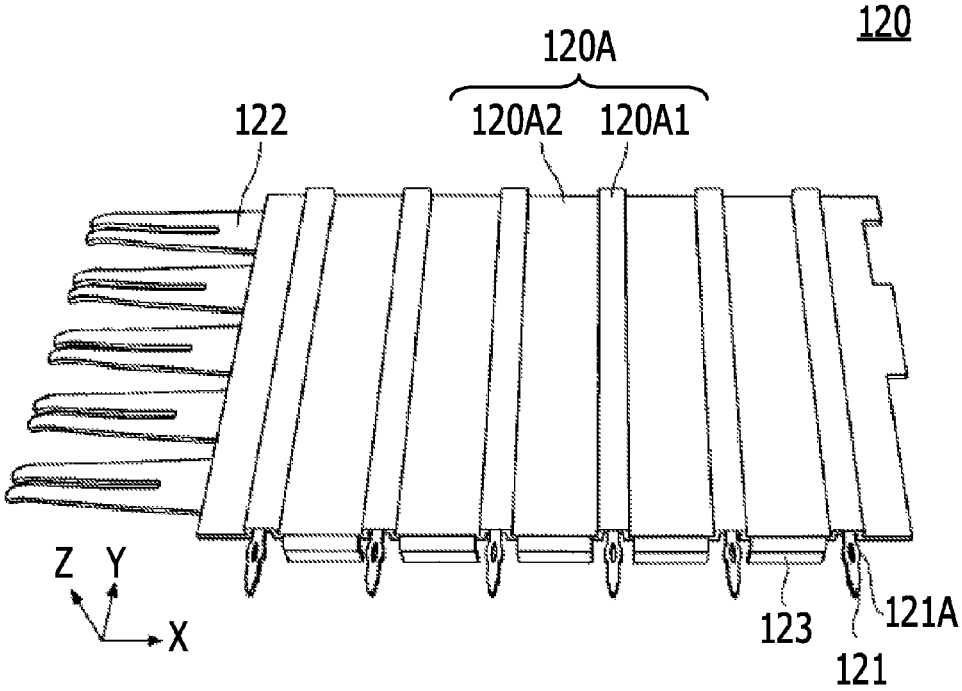
FIGS. 6A and 6B illustrate the elements of the connector according to the first embodiment.
Figure 6B:
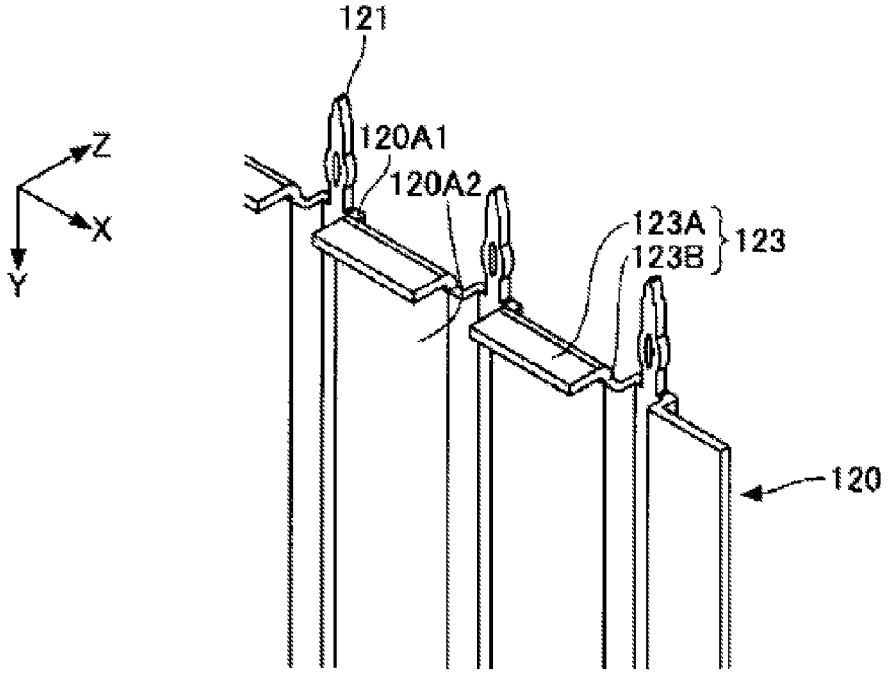

Out of FIGS. 5A to 6B, FIGS. 5A and 6A are plan views, and FIGS. 5B and 6B are enlarged perspective views illustrating parts of structures illustrated in FIGS. 5A and 6A. In FIGS. 5A to 6B, the XYZ-coordinate system, which is a rectangular coordinate system, is defined.

As illustrated in FIG. 3, the connector 100 includes chiclets 110, shield plates 120, and a housing 130. In FIG. 3, ten chiclets 110 and ten shield plates 120 are stacked in an alternating sequence and inserted into a single housing 130.

Ten chiclets 110 and ten shield plates 120 are designed such that each of the chiclets 110 is paired with a corresponding one of ten shield plates 120. In each of the pairs, the chiclet 110 is stacked on the shield plate 120 on the positive Z direction side of the shield plates 120.

As illustrated in FIGS. 4 and 5A, each of the chiclets 110 includes ten SMT terminals 111, ten contacts 112, and a molded resin portion 113. The chiclet 110 serves as an example of a board portion. The SMT terminals 111 each serve as an example of a signal terminal for surface mounting.

As illustrated in, for example, FIG. 3, when ten chiclets 110 and ten shield plates 120 have been inserted into the housing 130, the housing 130 and the molded resin portions 113 form a casing of the connector 100.

Ten SMT terminals 111 are each connected to a corresponding one of ten contacts 112. The SMT terminals 111 and the contacts 112 are exposed from the molded resin portion 113 when secured by the molded resin portion 113, which is formed by insert molding.

The chiclets 110 may be produced, for example, as follows: The molded resin portion 113 is formed by molding resin around a lead frame, which includes the SMT terminals 111 and the contacts 112, in an insert molding process, and after that, a frame portion of the lead frame is removed. The lead frame, which includes the SMT terminals 111 and the contacts 112, may be formed by, for example, punching a copper plate.

In the first embodiment, as an example, five pairs of the adjacent SMT terminals 111 and five pairs of the adjacent ten contacts 112 are provided, and differential signals are transmitted through the respective pairs of SMT terminals 111 and the respective pairs of the contacts 112.

As illustrated in FIGS. 5A and 5B, the SMT terminals 111 each extend from the molded resin portion 113 in the negative Y direction and are bent to the negative Z direction side.

Referring to FIG. 5B, two of ten SMT terminals 111 illustrated in FIG. 5A are described in detail. As illustrated in FIG. 5B, the SMT terminals 111 each have a tip end portion 111A and a base portion 111B. The tip end portion 111A is bent to the negative Z direction side relative to the base portion 111B that extends from the molded resin portion 113 in the negative Y direction.

It is desirable that the angle by which the tip end portion 111A is bent to the negative Z direction side relative to the base portion 111B be less than 90 degrees. That is, the SMT terminal 111 has a slightly opening right-angled L shape in side view.

The reason for this is to cause the SMT terminals 111 to exert spring elastic forces so that, when moving the connector 100 close to a surface of a board to be connected to the connector 100 in a direction perpendicular to the surface of the board and bringing the tip end portions 111A into contact with pads or the like of the board, the tip end portions 111A are brought into contact with the pads while being pressed against the pads.

The contacts 112 extend from the molded resin portion 113 in the negative X direction. Ten contacts 112 are each connected to a corresponding one of ten SMT terminals 111 in the molded resin portion 113. The contacts 112 are connected to signal input terminals or signal output terminals of an electronic device to which the connector 100 is connected.

Referring to FIGS. 4 to 5B, the contacts 112 extend from the molded resin portion 113 to the negative X direction side. However, the contacts 112 may extend from the molded resin portion 113 to the positive X direction side or the positive Y direction side.

That is, the contacts 112 may extend in a direction perpendicular to the SMT terminals 111 in plain view (plan view of the XY plane) or in a direction rectilinear (coaxial) with the SMT terminals 111.

The molded resin portion 113 is formed by, for example, molding a thermosetting epoxy resin in an insert molding process. The molded resin portion 113 is a plate-shaped member having a rectangular shape in plain view (plan view of the XY plane).

Ten signal wires are disposed in the molded resin portion 113. In each of ten signal wires, one end is the SMT terminal 111 and the other end is the contact 112. Furthermore, groove portions 113A and rib portions 113B, which respectively correspond to rib portions 120A1 and groove portions 120A2, are formed in a surface of the molded resin portion 113 to be in contact with the shield plate 120. Also in the molded resin portion 113, rib portions 113C and groove portions 113D are formed in a surface on a side opposite to the surface where the groove portions 113A and the rib portions 113B are formed. The positions of the groove portions 113A and the groove portions 113D are shifted from one another in the X direction. Likewise, the positions of the rib portions 113B and the rib portions 113C are shifted from one another in the X direction.

As illustrated in FIGS. 4 and 6A, the shield plate 120 includes a plate portion 120A, press-fit pins 121, contacts 122, and shielding portion 123. The shield plate 120 is formed by, for example, punching a copper plate.

The plate portion 120A is a rectangular plate-shaped member having the substantially the same size and shape as those of the molded resin portion 113 of the chiclet 110 in plain view (plan view of the XY plane). Six of the press-fit pin 121 and five of the shielding portion 123 are formed in an edge of the plate portion 120A on the negative Y direction side.

The plate portion 120A has six rib portions 120A1 and five groove portions 120A2. The rib portions 120A1 are at positions higher than those of the groove portions 120A2 in the Z direction. The rib portions 120A1 and the groove portions 120A2 are formed in the Y direction.

Six press-fit pins 121 are each connected to a corresponding one of six rib portions 120A1, and five shielding portions 123 are each connected to a corresponding one of five groove portions 120A2.

In other words, six press-fit pins 121 each extend from a corresponding one of six rib portions 120A1 in the negative Y direction, and five shielding portions 123 each extend from a corresponding one of five groove portions 120A2 in the negative Y direction.

The difference in level between the rib portions 120A1 and the groove portions 120A2 in the Z direction is set such that, when the chiclet 110 is stacked on the positive Z direction side of the shield plate 120, the level of the press-fit pins 121 in the Z direction is set at the same level as that of the base portions 111B of the SMT terminals 111 in the Z direction.

The contacts 122 are formed in an edge of the plate portion 120A on the negative X direction side. Referring to FIGS. 4 and 6A, the contacts 122 in one shield plate 120 divided into a total of ten tip ends. However, the contacts 122 may be divided into any number of tip ends, or the contacts 122 are not necessarily divided.

The press-fit pins 121 are formed in an edge of the plate portion 120A on the negative Y direction side. Six press-fit pins 121 and five shielding portions 123 are arranged in an alternating sequence. The press-fit pins 121 are disposed on both sides of five shielding portions 123.

The press-fit pins 121 are connected to ground terminals of the electronic device, to which the connector 100 is connected, through the contacts 122. The press-fit pins 121 each serve as an example of the ground terminal.

The press-fit pins 121 are press fitted into through holes of the board to be connected to the connector 100. In a state in which the press-fit pins 121 have been press fitted into the through holes, press-fitting portions 121A of the press-fit pins 121 are positioned further to the negative Y direction side than the tip ends of the shielding portions 123 in order to avoid contact of the shielding portions 123 with the board connected to the connector 100.

The press-fit pins 121, each of which extends from a corresponding one of the rib portions 120A1 in the negative Y direction, are disposed at positions higher than those of the shielding portions 123 in the Z direction. The reason for this is that, when the chiclet 110 is stacked on the positive Z direction side of the shield plate 120, the level of the press-fit pins 121 in the Z direction is at the same level as those of the base portions 111B of the SMT terminals 111 in the Z direction.

The press-fit pins 121 are each disposed at a position not superposed with corresponding one pair out of five pairs of ten SMT terminals 111 in plain view (plan view of the XY plane).

The contacts 122 are connected to ground terminals of the electronic device to which the connector 100 is connected.

Referring to FIGS. 4 and 6A, the contacts 122 are formed on the negative X direction side of the plate portion 120A. However, the contacts 122 may be formed on the positive X direction side or the positive Y direction side of the plate portion 120A.

That is, the contacts 122 may extend in a direction perpendicular to the press-fit pins 121 and the shielding portions 123 in plain view (plan view of the XY plane) or in a direction rectilinear (coaxial) with the press-fit pins 121 and the shielding portions 123.

FIG. 6B is an enlarged perspective view of three press-fit pins 121 and two shielding portions 123 out of six press-fit pins 121 and five shielding portions 123 illustrated in FIG. 6A.

The shielding portions 123 each have a tip end portion 123A and a base portion 123B. The base portion 123B of the shielding portion 123 is formed such that the base portion 123B extends in the negative Y direction from an edge of the groove portion 120A2 of the plate portion 120A on the negative Y direction side and is bent in the negative Z direction by 90 degrees. The tip end portion 123A extends in the negative Z direction.

Accordingly, as illustrated in FIG. 6B, the position of the base portion 123B of the shielding portion 123 in the Z direction is different from that of the press-fit pins 121. The base portion 123B is disposed further to the negative Z direction side than the press-fit pins 121.

The difference in level between the rib portions 120A1 and the groove portions 120A2 in the Z direction is set such that, when the chiclet 110 is stacked on the positive Z direction side of the shield plate 120, the level of the press-fit pins 121 in the Z direction is set at the same level as that of the base portions 111B of the SMT terminals 111 in the Z direction.

Thus, when the chiclet 110 is stacked on the positive Z direction side of the shield plate 120, the positions of the press-fit pins 121 in the Z direction is the same as those of the base portions 111B of the SMT terminals 111 in the Z direction.

Furthermore, when the chiclet 110 is stacked on the positive Z direction side of the shield plate 120, the base portions 123B of the shielding portions 123 are located further to the negative Z direction side than the press-fit pins 121 and the base portions 111B of the SMT terminals 111.

Furthermore, the length of the base portions 123B of the shielding portions 123 in the Y direction is set so as to cause the tip end portions 123A to be located further to the positive Y direction side than the tip end portions 111A of the SMT terminals 111 when the chiclet 110 is stacked on the positive Z direction side of the shield plate 120.

The shielding portions 123 are each disposed at a position superposed with corresponding one pair out of five pairs of ten SMT terminals 111 in plain view (plan view of the XY plane). With this structure, the SMT terminals 111 are shielded by the shielding portions 123 when the connector 100 is connected to the board.

The width of each of the shielding portions 123 in the X direction is larger than the width between an end portion on the negative X direction side of the SMT terminal 111 on the negative X direction side out of a corresponding pair of the SMT terminals 111 and an end portion on the positive X direction side of the SMT terminal 111 on the positive X direction side out of the corresponding pair of the SMT terminals 111.

With this structure, when the chiclet 110 is stacked on the positive Z direction side of the shield plate 120, each shielding portion 123 shields a corresponding pair of the SMT terminals 111 by covering the corresponding pair of the SMT terminals 111 in the X direction.

Herein, two SMT terminals 111 are shielded by one shielding portion 123. When one SMT terminal 111 is shielded by one shield, it is sufficient that the width of the shielding portion 123 be larger than the width of one SMT terminal 111.

When three or more SMT terminals 111 are shielded by one shield, it is sufficient that the width of the shielding portion 123 be larger than the following width: the width between an end portion on the negative X direction side of the SMT terminal 111 on the most negative X direction side out of three or more SMT terminals 111 to be shielded by this shielding portion 123 and an end portion on the positive X direction side of the SMT terminal 111 on the most positive X direction side out of the three SMT terminals 111.

Next, with reference to FIGS. 7 to 11, the SMT terminals 111 and the shielding portions 123 are described when the chiclets 110 and the shield plates 120 are inserted into the housing 130 such that the chiclets 110 are each stacked on the positive Z direction side of a corresponding one of the shield plates 120.

Figure 7:
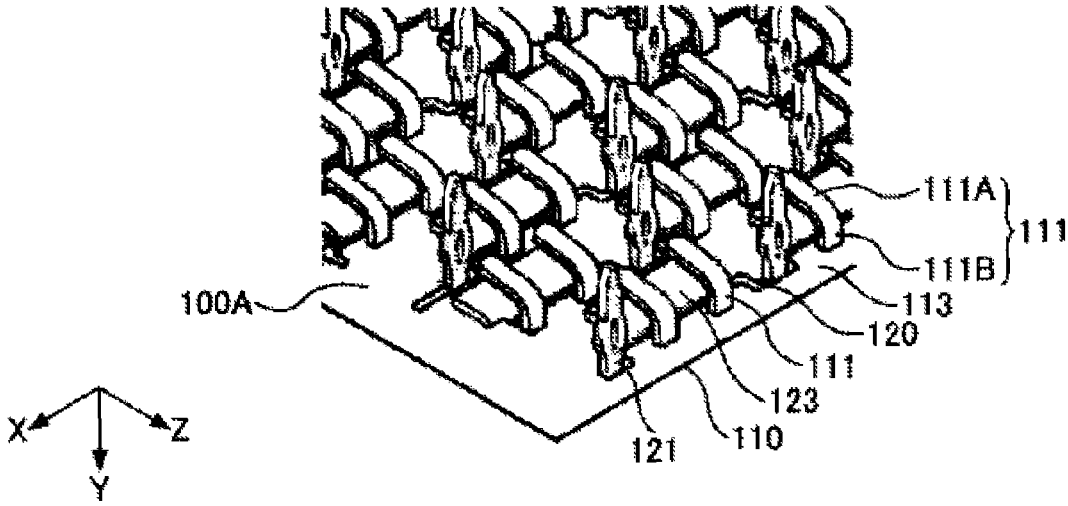
FIG. 7 illustrates a state in which chiclets and shield plates of the connector according to the first embodiment are stacked one on top of another.
Figure 8:
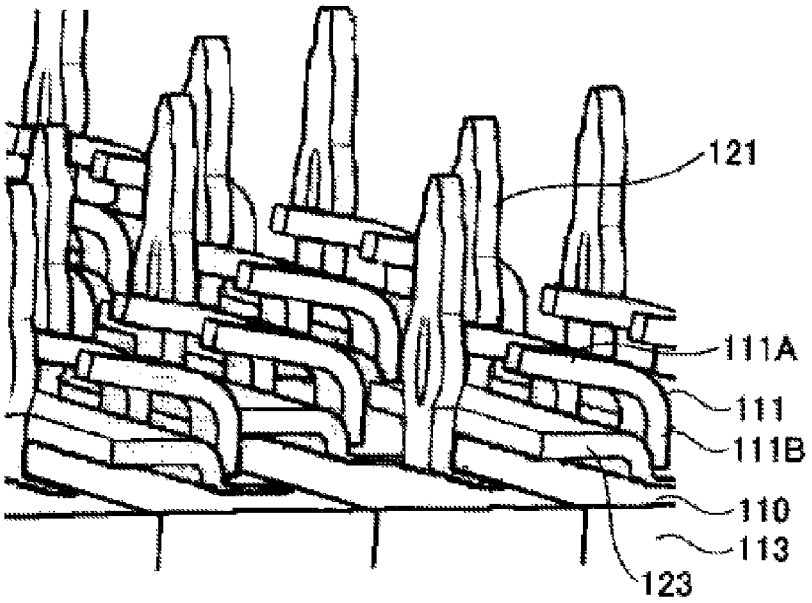
FIG. 8 illustrates a state in which the chiclets and the shield plates of the connector according to the first embodiment are stacked one on top of another.
Figure 9:
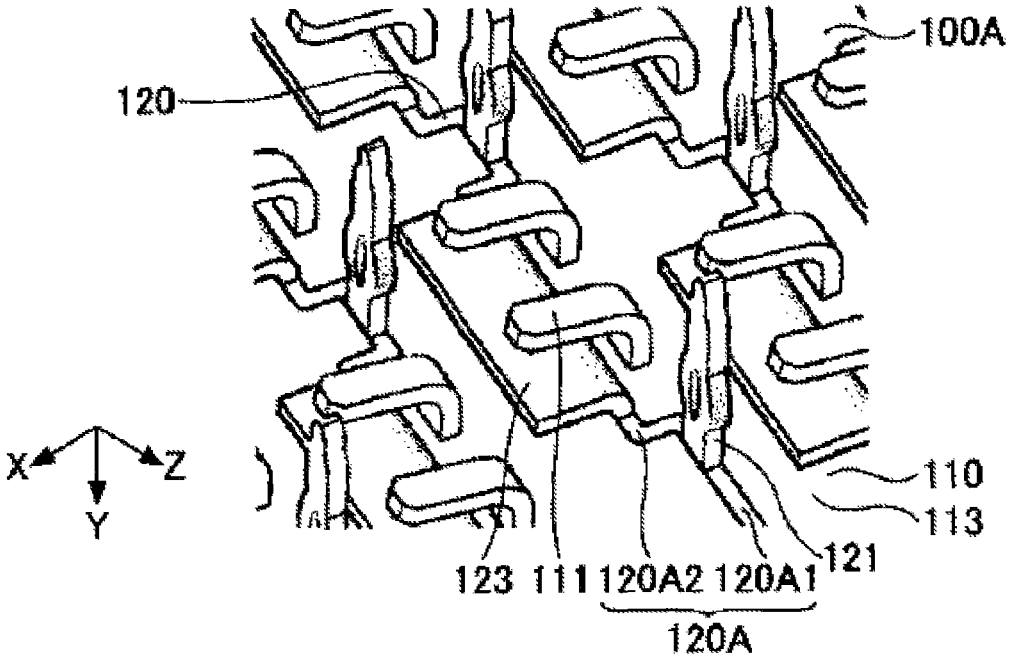
FIG. 9 illustrates a state in which the chiclets and the shield plates of the connector according to the first embodiment are stacked one on top of another.
Figure 10:
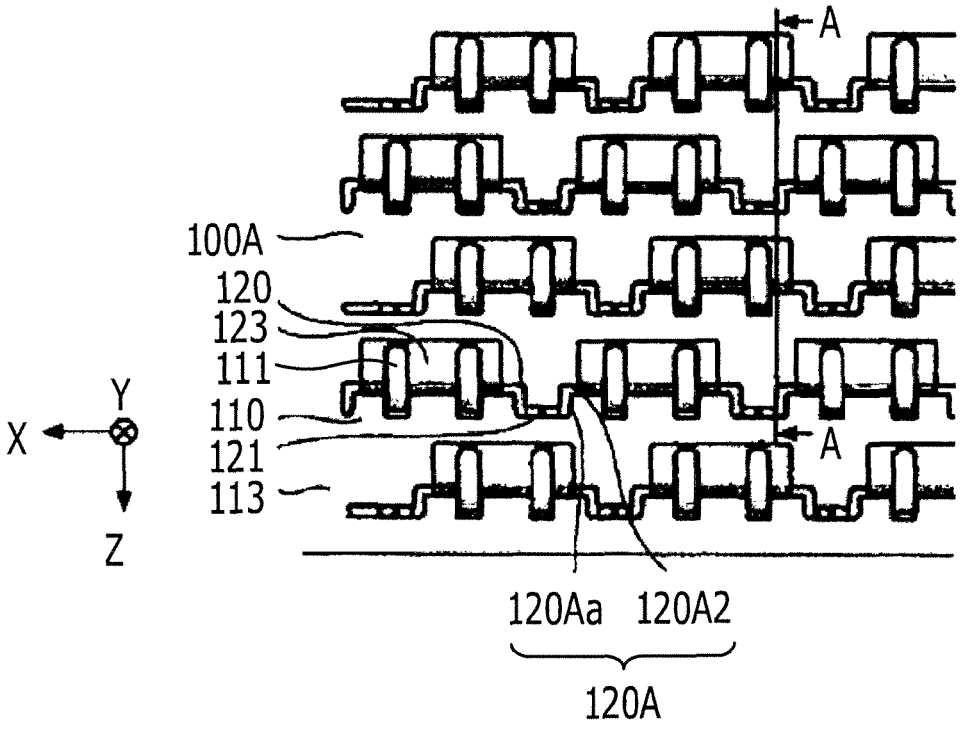
FIG. 10 illustrates a state in which the chiclets and the shield plates of the connector according to the first embodiment are stacked one on top of another.
Figure 11:
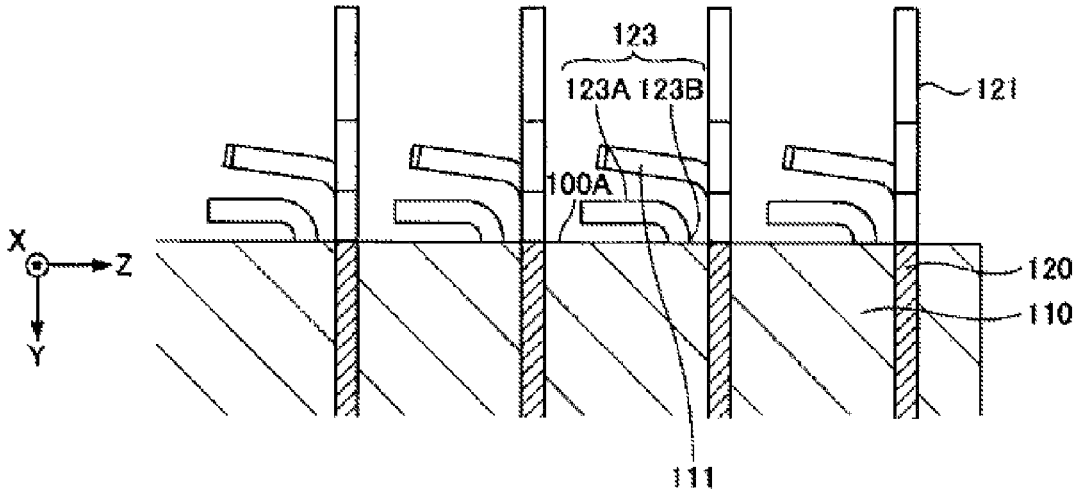
FIG. 11 illustrates a state in which the chiclets and the shield plates of the connector according to the first embodiment are stacked one on top of another.

FIGS. 7 to 11 illustrate a state in which the chiclets 110 and the shield plates 120 of the connector 100 according to the first embodiment are stacked. FIGS. 7 to 9 are perspective views seen from different viewpoints. FIG. 10 is a plan view of the XZ plane seen from the negative Y direction side. FIG. 11 is a sectional view of a structure illustrated in FIG. 10 taken along line XI-XI in FIG. 10. In FIGS. 7, 9, 10, and 11, the XYZ coordinate system similar to that defined in FIGS. 5A to 6B is defined.

In FIGS. 7 to 11, it is assumed that, when a pair of the chiclet 110 and the shield plate 120 are illustrated, the shield plate 120 is stacked on the negative Z direction side of the chiclets 110. In other words, the chiclet 110 is stacked on the positive Z direction side of the shield plate 120.

Here, in FIGS. 7 to 11, elements included in a single pair of the chiclet 110 and the shield plate 120 out of ten pairs of the chiclets 110 and the shield plates 120 actually included in a single connector 100 are denoted by reference signs.

A surface 100A is parallel to the XZ planes of ten pairs of the chiclet 110 and the shield plate 120 (ten chiclets 110 and ten shield plates 120). As illustrated in FIGS. 7 to 11, when ten chiclets 110 and ten shield plates 120 are inserted into the housing 130 such that the chiclets 110 and the shield plates 120 are stacked one on top of another, ten chiclets 110 and ten shield plates 120 form the flat surface 100A parallel to the XZ planes.

The surface 100A is formed by end surfaces of the molded resin portions 113 included in ten chiclets 110 and end surfaces of the plate portions 120A included in the ten shield plates 120. The surface 100A serves as an example of a surface of the casing of the connector 100 according to the first embodiment.

The SMT terminals 111 included in ten chiclets 110 extend from the surface 100A in the negative Y direction and are bent to the negative Z direction side.

The angle by which the tip end portions 111A are bent from the base portions 111B of the SMT terminals 111 to the negative Z direction side is less than 90 degrees. As illustrated in FIGS. 7 to 9, the SMT terminals 111 have a slightly opening right-angled L shape in side view.

Furthermore, because of the difference in level in the Z direction between the rib portions 120A1 and the groove portions 120A2 of the shield plate 120 (see FIGS. 6A and 6B), the level of the press-fit pins 121 and the level of the base portions 111B of the SMT terminals 111 are the same in the Z direction.

Furthermore, the press-fit pins 121 included in ten shield plates 120 extend from the surface 100A in the negative Y direction.

The shielding portions 123 included in ten shield plates 120 extend from the surface 100A in the negative Y direction and are bent to the negative Z direction side.

More specifically, in each of the shielding portions 123, the base portion 123B is formed such that the base portion 123B extends in the negative Y direction from the edge of the groove portion 120A2 of the plate portion 120A on the negative Y direction side and is bent in the negative Z direction by 90 degrees, and the tip end portion 123A extends in the negative Z direction.

For this reason, the base portions 123B of the shielding portions 123 are located further to the negative Z direction side than the press-fit pins 121 and the base portions 111B of the SMT terminals 111.

Furthermore, the shielding portions 123 are each disposed at positions superposed with a pair of the SMT terminals 111. The width of each of the shielding portions 123 in the X direction is larger than the width between the end portion on the negative X direction side of the SMT terminal 111 on the negative X direction side out of a corresponding pair of the SMT terminals 111 and the end portion on the positive X direction side of the SMT terminal 111 on the positive X direction side out of the corresponding pair of the SMT terminals 111.

The length of the base portions 123B of the shielding portions 123 in the Y direction is set so as to cause the tip end portions 123A to be located further to the positive Y direction side than the tip end portions 111A of the SMT terminals 111 when the chiclets 110 are stacked on the positive Z direction side of the shield plates 120.

Thus, as illustrated in FIGS. 7 to 11, when the chiclets 110 are stacked on the positive Z direction side of the shield plates 120, the pairs of the SMT terminals 111 are positioned on the negative Y direction side (upper side in, for example, FIGS. 7 to 9) of the shielding portions 123 having been bent to have an L-shape.

This means that, in the YZ plane as illustrated in FIG. 11, the shielding portions 123 having been bent to have an L-shape are positioned inside the SMT terminals 111 having been bent to have an L-shape. That is, the shielding portions 123 are bent inside the SMT terminals 111.

As described above, in the connector 100 according to the first embodiment, the shielding portions 123 having been bent to have an L-shape are disposed along the SMT terminals 111 having been bent to have an L-shape and each of the shielding portions 123 is disposed near a corresponding pair of the SMT terminals 111.

When the press-fit pins 121 of the connector 100 are press fitted into the through holes of the board to be connected, the surfaces of the tip end portions 111A of the SMT terminals 111, the surfaces located on the negative Y direction side, (upper surfaces in FIGS. 7 to 11) are brought into contact with the pads or the like of the board to be connected. In this state, the connector 100 may be connected to the board to be connected by soldering the tip end portions 111A of the SMT terminals 111 to the pads or the like of the board to be connected.

Here, a state in which the connector 100 according to the first embodiment is connected to a board 5A is described with reference to FIGS. 12A and 12*b*.

Figure 12A:
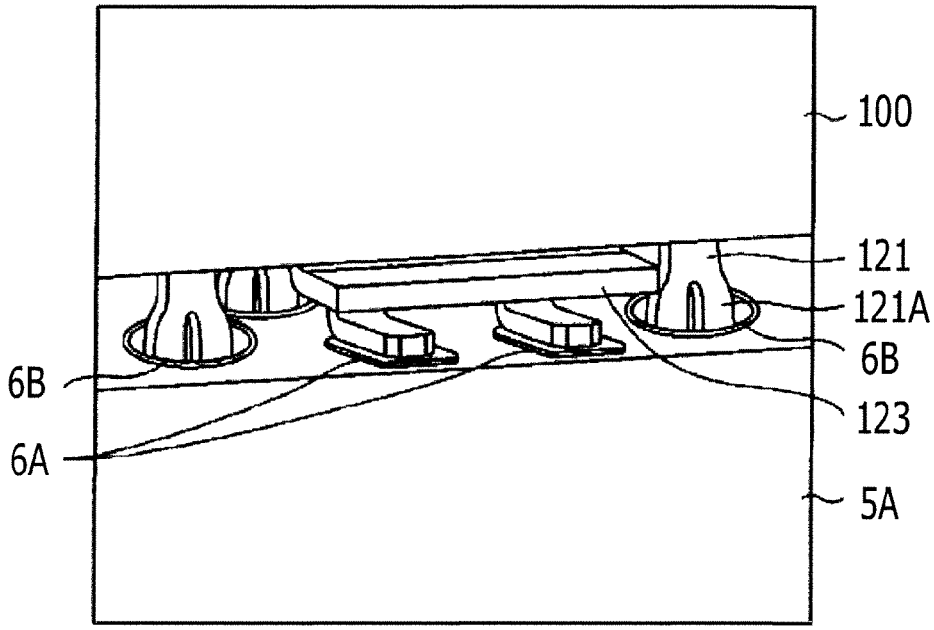
FIGS. 12A and 12B illustrate a state in which the connector according to the first embodiment is connected to a board.
Figure 12B:
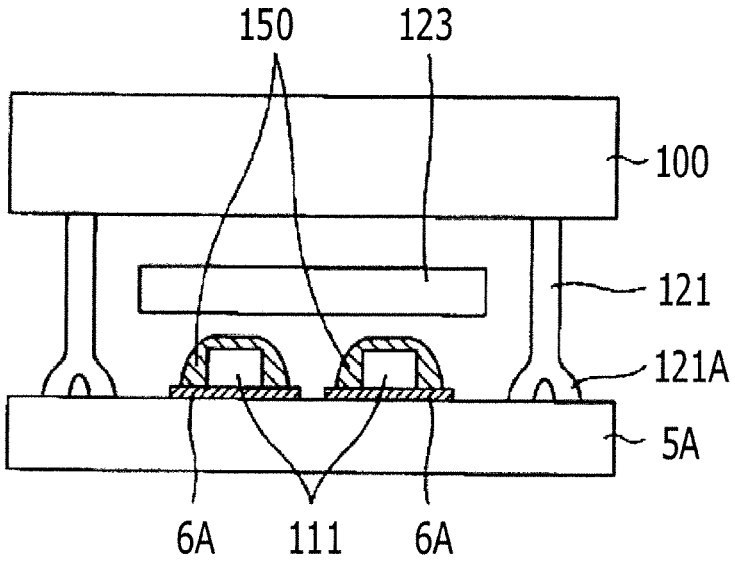

FIGS. 12A and 12B illustrate a state in which the connector 100 according to the first embodiment is connected to the board 5A.

Specifically, FIG. 12A illustrates a state in which the SMT terminals 111 of the connector 100 are brought into contact with pads 6A of the board 5A and the press-fitting portions 121A of the press-fit pins 121 are press fitted into through holes 6B of the board 5A. That is, in FIG. 12A, the connector 100 according to the first embodiment is connected to the board 5A.

FIG. 12B illustrates the positional relationships among the SMT terminals 111, the pads 6A, the press-fit pins 121, and the shielding portions 123 when the connector 100 according to the first embodiment is connected to the board 5A. In FIG. 12B, the SMT terminals 111 are joined to the pads 6A of the board 5A by solder 150. The joining using the solder 150 may be performed in, for example, a reflow process.

As illustrated in FIGS. 12A and 12B, when the connector 100 is connected to the board 5A, the SMT terminals 111 are covered by the shielding portions 123.

Accordingly, when the SMT terminals 111 of the connector 100 are connected to the pads 6A of the board 5A by an SMT method, introduction of noise or the like into the SMT terminals 111 may be suppressed, and accordingly, impedance matching of the SMT terminals 111 may be improved. As a result, signal transmission characteristics may be improved.

Figure 13A:
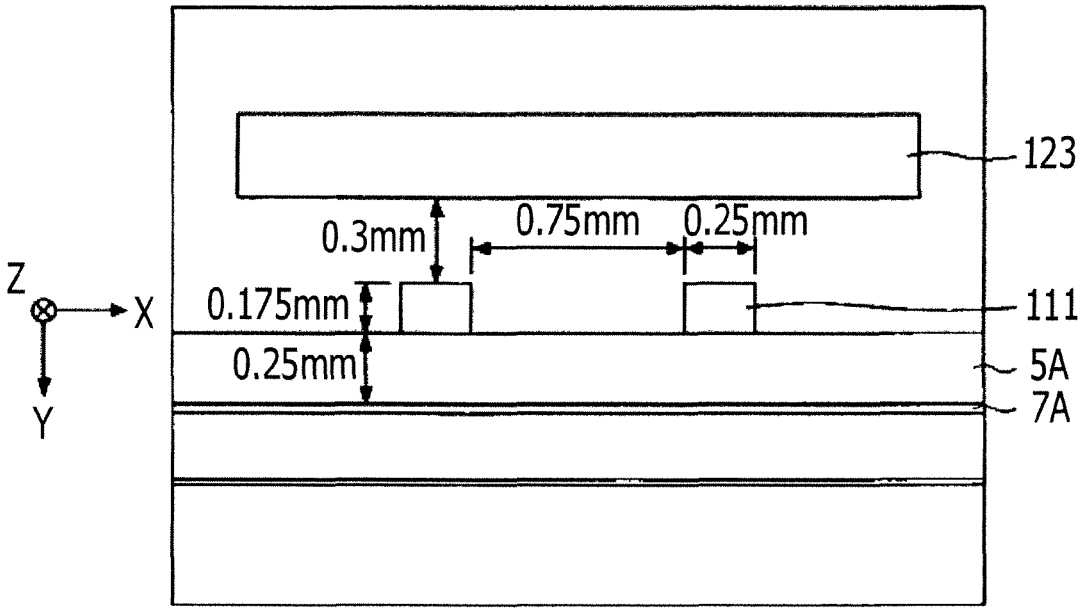
FIGS. 13A and 13B illustrate simulation results of the connector according to the first embodiment.
Figure 13B:
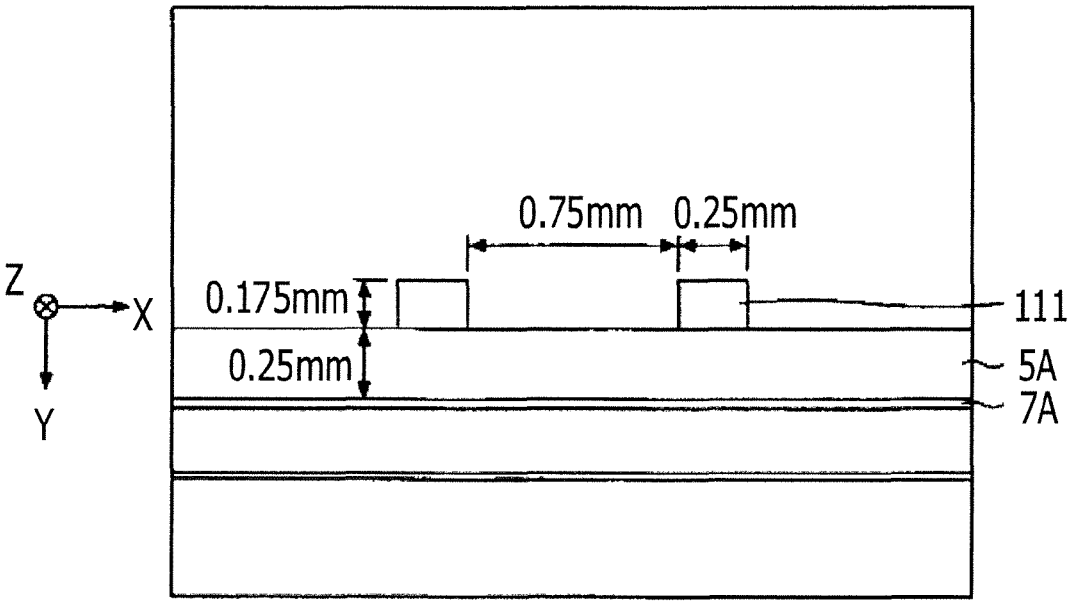

FIGS. 13A and 13B illustrate simulation results of the connector 100 according to the first embodiment. In FIGS. 13A and 13B, the XYZ coordinate system similar to that defined in FIGS. 5A to 6B and FIGS. 7 and FIGS. 9 to 11 is defined.

In FIG. 13A, the SMT terminals 111 of the connector 100 according to the first embodiment are mounted on the board 5A. In FIG. 13A, the SMT terminals 111, the shielding portion 123, the board 5A, and a ground layer 7A, which is an inner layer of the board 5A, are illustrated. In FIG. 13A the SMT terminals 111, the shielding portion 123, and the board 5A are illustrated similarly to FIG. 12B.

Here, in the simulation, dimensions and so forth are set as follows: the width and height of the SMT terminals 111 are respectively 0.25 mm and 0.175 mm; the interval between a pair of the SMT terminals 111 is 0.75 mm; the interval between SMT terminal 111 and the shielding portion 123 is 0.3 mm; and the distance between the surface of the board 5A to the ground layer 7A (the depth from the surface of the board 5A to the surface of the ground layer 7A) is 0.25 mm. The ground layer 7A uses copper foil disposed on one surface of the board 5A.

The characteristic impedance of the SMT terminals 111 illustrated in FIG. 13A is 100Ω.

FIG. 13B illustrates a structure, in which the shielding portion 123 illustrated in FIG. 13A is removed. The characteristic impedance of the SMT terminals 111 in the structure illustrated in FIG. 13B is 109Ω.

Thus, it is understood that, in the connector 100 according to the first embodiment, which includes the shielding portions 123, the characteristic impedance of the SMT terminals 111 may be significantly improved.

As described above, according to the first embodiment, the connector 100 having improved electrical characteristics may be provided.

For example, the connector 100 according to the first embodiment is usable for ultra-high speed transmission (for example, a transmission speed of equal to or higher than 40 Gbps).

Furthermore, impedance matching of the SMT terminals 111 is improved by the shielding portions 123. This suppresses reflection of signals, and accordingly, the signal transmission characteristics are further improved.

Furthermore, in the connector 100 according to the first embodiment, the press-fit pins 121 are disposed on both sides of each pair of the SMT terminals 111. That is, the press-fit pins 121, which are held at the ground potential, are disposed near both sides of each pair of the SMT terminals 111, through which high-speed differential signals are transmitted.

Thus, in the connector 100 according to the first embodiment, introduction of noise or the like into a single pair of the SMT terminals 111 may be suppressed by the press-fit pins 121. This may further improve impedance matching of the SMT terminals 111.

Furthermore, in the connector 100 according to the first embodiment signal transmission terminals use the SMT terminals 111. Unlike the press-fit pins 2 according to the underlying technology (see FIGS. 1A to 2), stubs are not formed by the SMT terminals 111.

Thus, in the connector 100 according to the first embodiment, compared to a case such as a case with the underlying technology where the press-fit pins 2 (see FIGS. 1A to 2) are used to transmit signals, the occurrence of reflection of high-speed signals or the like in the connector 100 is suppressed. This allows signal transmission characteristics to be improved. Such improvement of signal transmission characteristics becomes significant as the speed of signal transmission is increased.

Also in the connector 100 according to the first embodiment, the angle by which the tip end portions 111A are bent from the base portions 111B of the SMT terminals 111 to the negative Z direction side is less than 90 degrees, and the SMT terminals 111 have a slightly opening right-angled L shape in side view.

Thus, by causing the SMT terminals 111 to exert spring elastic forces when moving the connector 100 close to the surface of the board 5A in a direction perpendicular to the surface of the board 5A and bringing the tip end portions 111A into contact with the pads 6A, the tip end portions 111A are brought into contact with the pads 6A while being pressed against the pads 6A.

Accordingly, properties of the tip end portion 111A for connection with the pads 6A may be further improved. Thus, when the solder 150, by which the tip end portions 111A of the SMT terminals 111 are joined to the pads 6A, is not desired, the joining may be performed without the solder 150.

The reason for this is that the board 5A and the connector 100 are secured to each other by the press-fit pins 121 and the through holes 6B.

Actually, a number of SMT terminals 111 are provided corresponding to a number of pads 6A of the board 5A. There may be variation in height of the pads 6A of the board 5A.

Thus, particularly when the angle by which the tip end portions 111A are bent from the base portions 111B of the SMT terminals 111 to the negative Z direction side is less than 90 degrees, variation in height of the pads 6A may be addressed, and accordingly, so-called coplanarity may be improved.

Figure 14A:
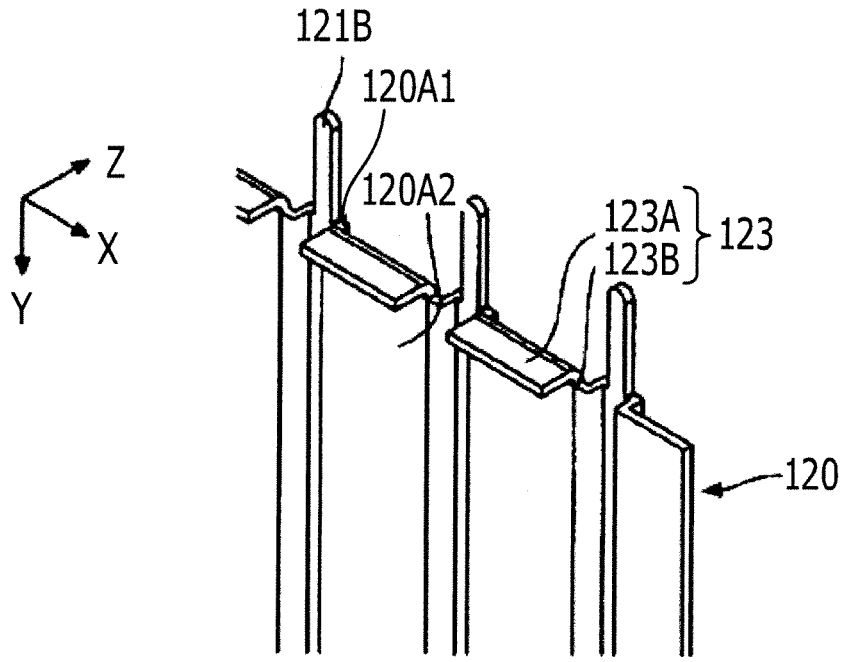
FIGS. 14A and 14B illustrate a variant of the first embodiment.
Figure 14B:
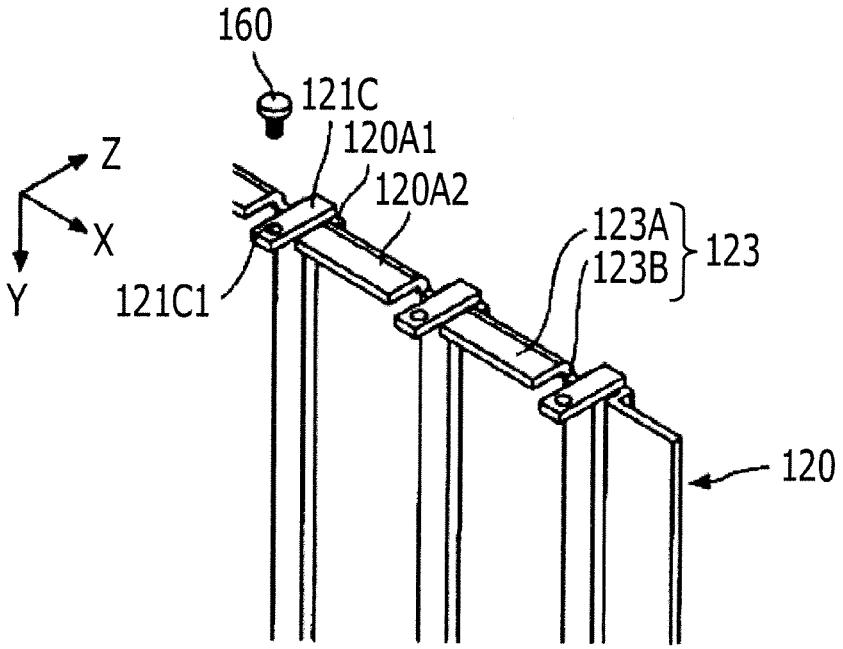

Although the shield plate 120 includes the press-fit type press-fit pins 121 in the above description, the shield plate 120 may include SMT terminals as illustrated in FIGS. 14A and 14B instead of the press-fit pins 121.

FIGS. 14A and 14B illustrate a variant of the first embodiment. As illustrated in FIG. 14A, the shield plate 120 may include DIP pins 121B. It is sufficient that the DIP pins 121B be inserted into the through holes 6B of the board 5A (see FIG. 12A) and joined by soldering.

As illustrated in FIG. 14B, the shield plate 120 may include SMT terminals 121C instead of the press-fit pins 121. The SMT terminals 121C may be secured, for example, as follows: that is, forming thread holes 121C1 in the SMT terminals 121C and securing the SMT terminals 121C to the pads on the front surface side of the board 5A by screws 160 inserted from a rear surface side (surface on a side opposite to the surface where the pads 6A are formed) of the board 5A. It is sufficient that such pads on the front surface side of the board 5A be formed on the surface of the board 5A instead of the through holes 6B illustrated in FIG. 12A.

The SMT terminals 121C may be connected to the pads of the board 5A without using the screws 160.

Alternatively, the SMT terminals 111 of the chiclets 110 may be secured by the screws 160.

Although the angle by which the tip end portions 111A are bent from the base portions 111B of the SMT terminals 111 to the negative Z direction side is less than 90 degrees in the above description, the angle by which the SMT terminals 111 are bent may be 90 degrees.

In the above description, as illustrated in, for example, FIG. 3, when ten chiclets 110 and ten shield plates 120 have been inserted into the housing 130, the housing 130 and the molded resin portions 113 form the casing of the connector 100.

Alternatively, the SMT terminals 111, the contacts 112, the plate portion 120A, the press-fit pins 121, the contacts 122, and the shielding portions 123 may be secured to a single casing in an insert molding process.

Second Embodiment

Figure 15A:
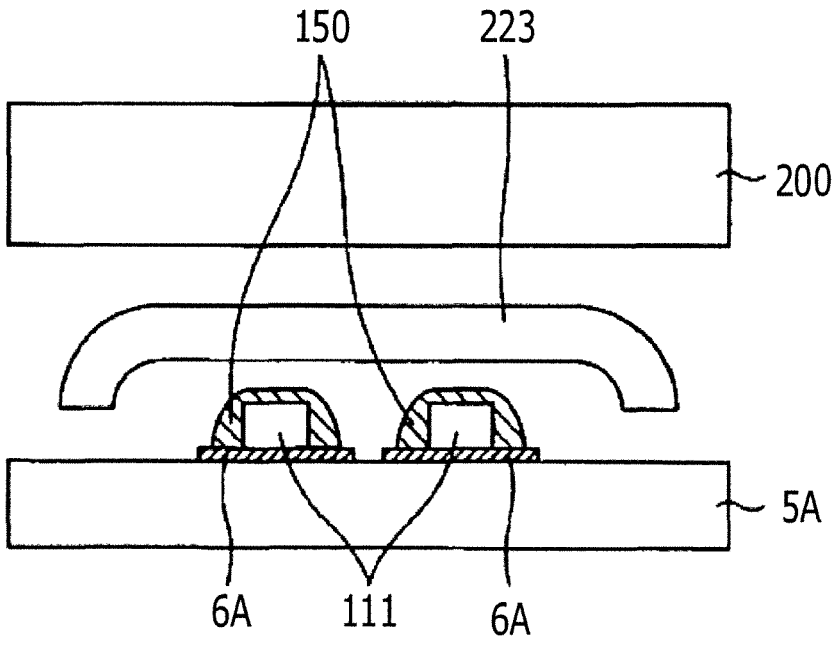
FIGS. 15A and 15B illustrate a connector according to a second embodiment.
Figure 15B:
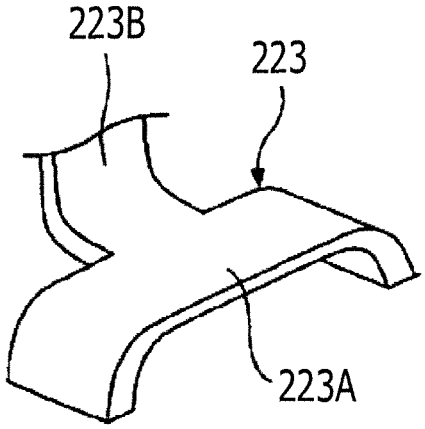

FIGS. 15A and 15B illustrate a connector 200 according to a second embodiment. FIG. 15A corresponds to FIG. 12B that illustrates the first embodiment. FIG. 15B is a perspective view of one of shielding portions 223.

The connector 200 according to the second embodiment is similar to the connector 100 according to the first embodiment except for the structure of the shielding portions 223, which is different from that of the shielding portions 123 of the first embodiment.

Accordingly, elements of the connector 200 similar to those of the connector 100 according to the first embodiment are denoted by the same reference signs and description thereof is omitted.

The shielding portions 223 each have a tip end portion 223A, which corresponds to the tip end portion 123A of the shielding portion 123 of the first embodiment. As illustrated in FIG. 15B, the tip end portion 223A has a width larger than that of a base portion 223B and is bent so as to cover side surfaces of the tip end portions 111A of the SMT terminals 111 (see FIG. 5B).

Thus, introduction of noise or the like into the SMT terminals 111 may be more effectively suppressed by the shielding portions 223, and accordingly, impedance matching of the SMT terminals 111 may be further improved.

Third Embodiment

Figure 16:
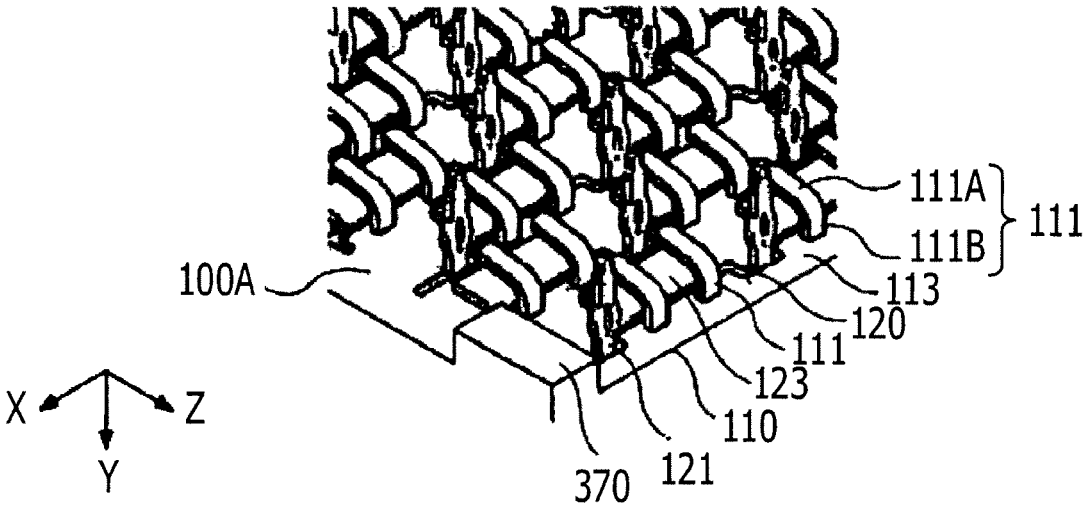
FIG. 16 illustrates part of a connector according to a third embodiment.
Figure 17:
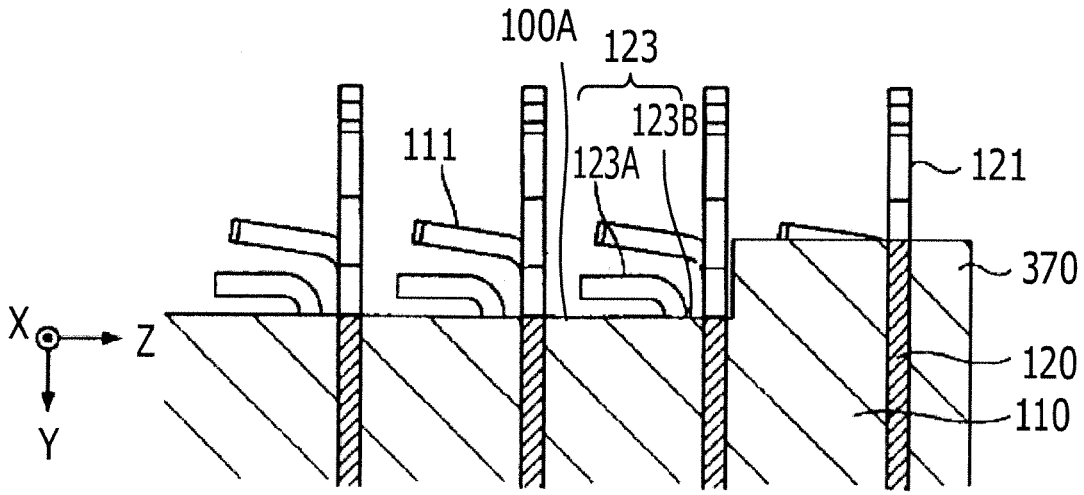
FIG. 17 illustrates part of the connector according to the third embodiment.

FIGS. 16 and 17 illustrate part of a connector according to a third embodiment. FIGS. 16 and 17 respectively correspond to FIGS. 7 and 11.

The molded resin portions 113 of the chiclets 110A of the connector according to the third embodiment have standoffs 370. The structure of the connector according to the third embodiment is similar to that of the connector 100 according to the first embodiment except for the standoffs 370. Thus, elements of the connector according to the third embodiment similar to those of the connector 100 according to the first embodiment are denoted by the same reference signs and description thereof is omitted.

The standoffs 370 are provided to avoid the occurrence of a situation in which the press-fit pins 121 are excessively inserted (excessively press fitted) into the through holes 6B of the board 5A (see FIG. 12A) and to adjust the length by which the press-fit pins 121 are inserted into the through holes 6B when the press-fit pins 121 are press fitted into the through holes 6B. The standoffs 370 each serve as an example of a step portion.

It is sufficient that the standoffs 370 are formed, for example, on a side surface of the molded resin portion 113 illustrated in FIG. 5A, the side surface being on the negative Y direction side, such that one standoff 370 is disposed at a side of the SMT terminal 111 at each ends of a row of ten SMT terminals 111. It is sufficient that the standoffs 370 are formed, for example, along with the molded resin portion 113 in an insert molding process.

It is sufficient that the height of the standoffs 370 is, as illustrated in FIG. 17, set to be an optimum height in accordance with the height of the SMT terminals 111, which has been bent to have an L-shape, so that the SMT terminals 111 are not crushed when the connector is connected to the board 5A (see FIG. 12A).

As described above, according to the third embodiment, the connector which has improved electrical characteristics and with which excessive press-fitting is suppressed during mounting, is provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a casing;

a pair of signal terminals that have respective tip end portions, the pair of signal terminals projecting from the casing, the tip end portions being perpendicularly bent;

a ground terminal arranged such that the ground terminal and the pair of signal terminals are arranged in a row, the ground terminal projecting at a position adjacent to the pair of signal terminals; and a shield disposed between the casing and the tip end portions of the pair of signal terminals.

2. The connector according to claim 1, wherein the pair of signal terminals has a spring shape by being bent in a direction perpendicular to a direction in which the signal terminals project from the casing.

3. The connector according to claim 1, wherein a width of the shield is larger than an interval between the arranged pair of signal terminals.

4. The connector according to claim 1, wherein the tip end portions of the pair of signal terminals each have a screw hole.

5. The connector according to claim 1, wherein the ground terminal is a press-fit type terminal press fitted into a ground terminal of a board to which the connector is coupled or an insert-type terminal inserted into the ground terminal of the board.

6. The connector according to claim 5, wherein the casing has a step portion on a surface that opposes the board to which the connector is coupled; the step portion adjusting a length by which the press-fit type terminal or the insert-type terminal is inserted into the ground terminal of the board.

7. The connector according to claim 1, wherein the pair of signal terminals is a pair of signal terminals for a differential signal.

8. The connector according to claim 1, wherein a plurality of the pairs of signal terminals are provided, a plurality of the ground terminals are provided, and a plurality of the shields are provided, wherein a plurality of first boards and a plurality of second boards are provided, wherein the pair of signal terminals project from an end portion of each of the first boards, the ground terminal projects from an end portion of each of the second boards, and the shield is disposed at a side of the ground terminal on each of the second boards, and wherein the first boards and the second boards are arranged in an alternating sequence in the casing.

* * * * *